US005731011A

United States Patent [19]

Agreen et al.

[11] Patent Number: 5,731,011

[45] Date of Patent: Mar. 24, 1998

[54] APPARATUS FOR FORMING A FIBROUS SHEET

[75] Inventors: Robert Carl Agreen, New Castle; Wayne Edward Billings, Middletown, both of Del.; Robert Anthony Marin, Midlothian, Va.; Jean Francois Woll, Bettembourg; Ottmar Niederpruem, Dalheim, both of Luxembourg; Michael Allen Bryner, Midlothian, Va.

[73] Assignee: E. I. du Pont de Nemours and Company, Wilmington, Del.

[21] Appl. No.: 791,971

[22] Filed: Jan. 31, 1997

Related U.S. Application Data

[63] Continuation of Ser. No. 460,740, Jun. 2, 1995, abandoned.

[51] Int. Cl.[6] ..... D01D 5/11

[52] U.S. Cl. ..... 425/135; 425/174.8 E; 425/377; 425/403.1; 425/404; 425/445; 264/465; 264/484; 264/205

[58] Field of Search ..... 425/72.2, 135, 425/174.8 E, 174, 404, 403.1, 402, 445, 377; 264/449, 465, 484

[56] References Cited

U.S. PATENT DOCUMENTS

| | | | |
|---|---|---|---|
| 3,497,918 | 3/1970 | Pollock, Jr. et al. | 264/205 |
| 3,504,076 | 3/1970 | Lee | 264/205 |
| 3,565,979 | 2/1971 | Palmer | 264/205 |
| 3,860,369 | 1/1975 | Brehauer et al. | 264/484 |
| 4,666,395 | 5/1987 | Shah | 425/377 |
| 4,968,238 | 11/1990 | Satterfield | 425/135 |
| 5,558,830 | 9/1996 | Powers, Jr. et al. | 264/465 |
| 5,643,524 | 7/1997 | Gilbert De Cauwer et al. | 264/465 |
| 5,667,562 | 9/1997 | Midkiff | 264/484 |

*Primary Examiner*—Khanh P. Nguyen

[57] ABSTRACT

An apparatus for adjusting the path that a web formed by striking a contoured surface baffle will take as it descends to a collection surface, in which the baffle is mounted on a pivot plate which will pivot and cause the web to leave the contoured surface baffle at the desired angle.

6 Claims, 2 Drawing Sheets

APPARATUS FOR FORMING A FIBROUS SHEET

RELATED APPLICATION

This is a continuation of application Ser. No. 08/460,740, filed Jun. 2, 1995, now abandoned.

FIELD OF THE INVENTION

This invention relates to an apparatus useful for the preparation of non-woven fibrous sheets of synthetic organic polymers. More particularly, the invention relates to that portion of such an apparatus where polymer dissolved in solution is ejected from a spinneret under conditions such that the solvent is vaporized, and the polymer forms a plexifilamentary strand which is projected against a rotating contoured baffle which causes the strand to form a web which the baffle spreads, oscillates, and directs to a collecting surface. The apparatus of this invention is particularly useful when used in combination with a plurality of other such assemblies in forming a non-woven fibrous sheet, and under conditions where one or more of said plurality of assemblies becomes inoperable. The apparatus of the invention is capable of adjusting the path of the web leaving the surface of the baffle, so that the web will reach the collecting surface in a pattern that will minimize the effect of the inoperable assembly. When a plurality of assemblies are functioning to make a non-woven sheet and one assembly becomes inoperable, some of the remaining assemblies are adjusted, and the speed of the collection belt is reduced, and the product obtained is approximately the same as when all the assemblies are operating.

This invention also relates in a process for producing a fibrous sheet.

BACKGROUND OF THE INVENTION

Brethauer et al. U.S. Pat. No. 3,860,369 discloses an apparatus for forming non-woven fibrous sheets.

Marshall U.S. Pat. No. 5,123,983 discloses an apparatus for forming non-woven fibrous sheets in which the flow of the vaporized solvent (gas) which entrains the web is regulated so that the sheet product is less likely to be disturbed by the gas flow.

Pollock et al. U.S. Pat. No. 3,497,918 discloses a contoured baffle of the type suitable for use in apparatus described in the Brethauer etal. Patent, the Marshall Patent, and in the apparatus of the present invention.

SUMMARY OF THE INVENTION

The present invention is an apparatus for forming a fibrous web which comprises:

(a) a stationary frame, (b) a pivot plate mounted to said stationary frame for movement about a pivot point axis, (c) means for flash spinning a polymer solution to form a plexifilamentary strand entrained in a gaseous stream located adjacent said pivot point and positioned so that the trajectory path of the stream and the pivot point axis are coincident (or at least approximately coincident), (d) a baffle mounted for rotation on said pivot plate having its center of rotation adjacent the pivot point axis of the pivot plate, said baffle intersecting the coincident axis of the pivot point and the trajectory path of the stream, said baffle having a contoured surface facing the means for flash spinning, whereby plexifilamentary strand upon striking the contoured surface of the baffle will be spread to form a web, (e) means for moving said pivot plate about its pivot point axis whereby the angle at which plexifilamentary strand entrained in the gaseous stream leaves the baffle after striking the contours of the contoured surface of the baffle may be adjusted and thereby alter the direction web moves on leaving the surface of the baffle and/or the amplitude of oscillation of the web.

Preferably, the baffle mounted for rotation has an axis of rotation that is parallel to the pivot point axis.

The apparatus also includes a charging means located below the baffle for forming an electrostatic charge on the web and thus further spreads the web.

The apparatus also includes an aerodynamic shield extending below the charging means, said shield helping to control the direction of movement of the charged web.

The apparatus also includes a collecting belt located below the aerodynamic shield, said collecting belt being adapted to receive and convey the web.

The apparatus also includes the means for moving the pivot plate so that it moves on the pivot point axis and includes a computer controlled motor acting through a gear and pinion.

The apparatus also includes a baffle which has a contoured surface having at least 3 lobes that are spaced equally around the axis of rotation of the baffle. Such a contoured baffle is described in Pollock's U.S. Pat. No. 3,497,918.

The invention is also process for the production of a fibrous sheet which comprises forming a plexifilamentary strand, forming a web from said plexifilamentary strand, moving the web in a path toward a collection station, and adjusting said path.

DETAILED DESCRIPTION

Figure 1:
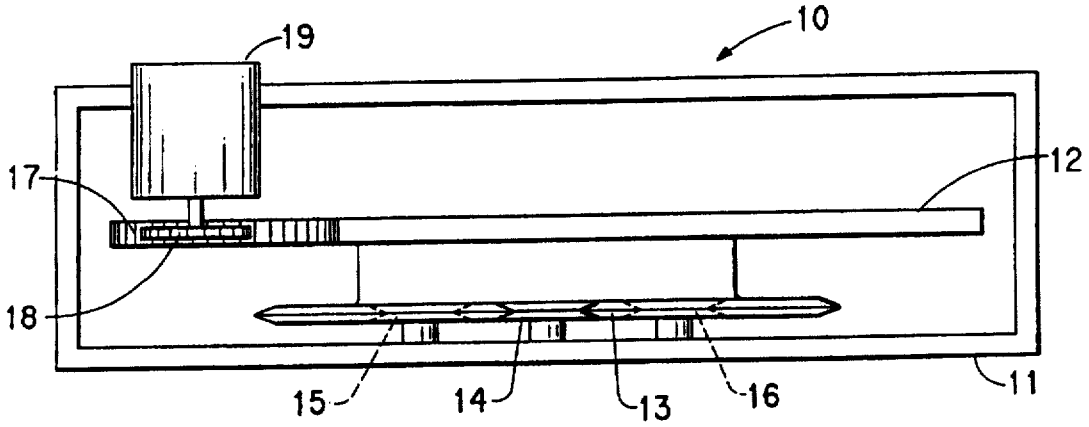
FIG. 1 is a top plan view of a portion of the apparatus of the invention.

In the preparation of the non-woven sheets of commerce, a plurality of assemblies of the type shown in FIG. 1 of Brethauer et al. U.S. Pat. No. 3,860,369, which patent is incorporated by reference, have been mounted above the collecting belt. The assemblies are often mounted in a plurality of staggered rows, and the individual assemblies in each row are sufficiently close together that the webs overlay on the collecting belt, and the assemblies are off-set from one row to the next, so that each succeeding row of assemblies lays the webs in a different position than the prior row of assemblies. When operating in the above manner using assemblies of the type shown in FIG. 1 of Brethauer et al., if one assembly became inoperative, the resulting non-woven sheet would be thin in the area where the inoperative assembly would have laid its web.

The present invention provided an apparatus for making a non-woven sheet in which the inoperability of one or more assemblies can be offset, and the non-woven sheet product will still be commercially acceptable.

The apparatus of the present invention adjusts the trajectory path of the web coming from an assembly causing the web to cover, or in conjunction with other assemblies, the area on the collection surface that would have been covered by the inoperative assembly. In practice when one or more assemblies becomes inoperative, other assemblies are adjusted and the trajectory paths of the webs from the adjusted assemblies offset the blemish that would otherwise result from the inoperative assemblies. The speed of the collection belt may also need to be adjusted. The assemblies and collection belt speed may be adjusted by a suitable computer control.

Figure 2:
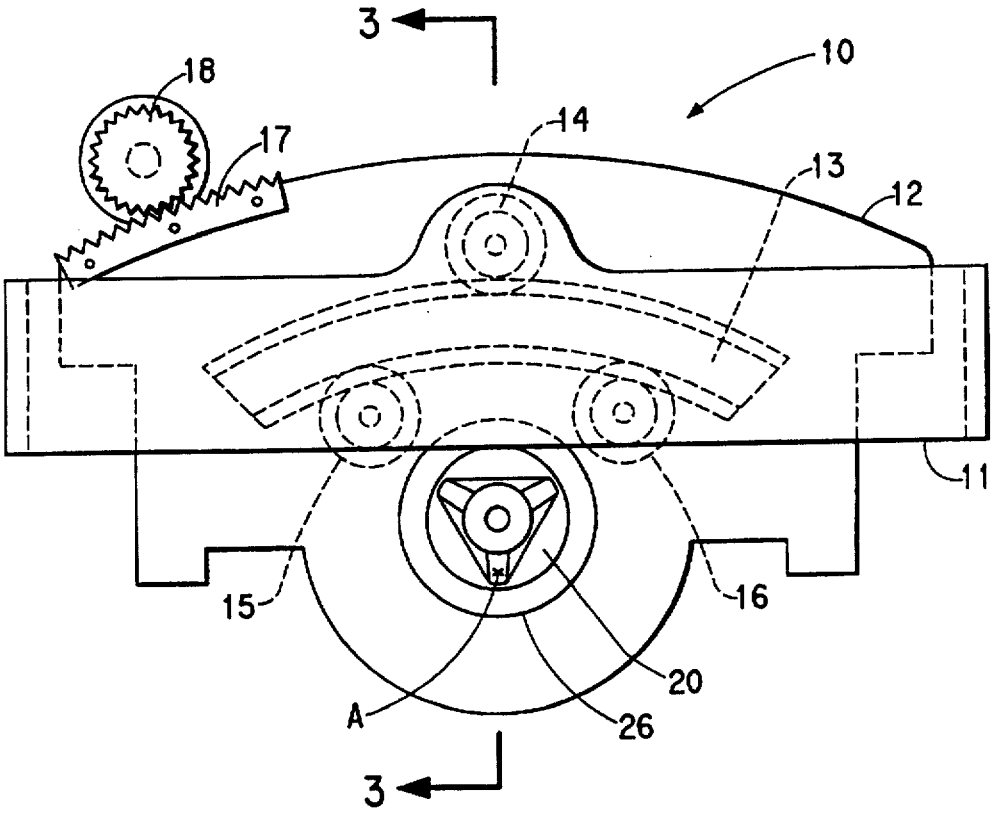
FIG. 2 is a front elevational view of the same portion of the apparatus of the invention shown in FIG. 1.
Figure 3:
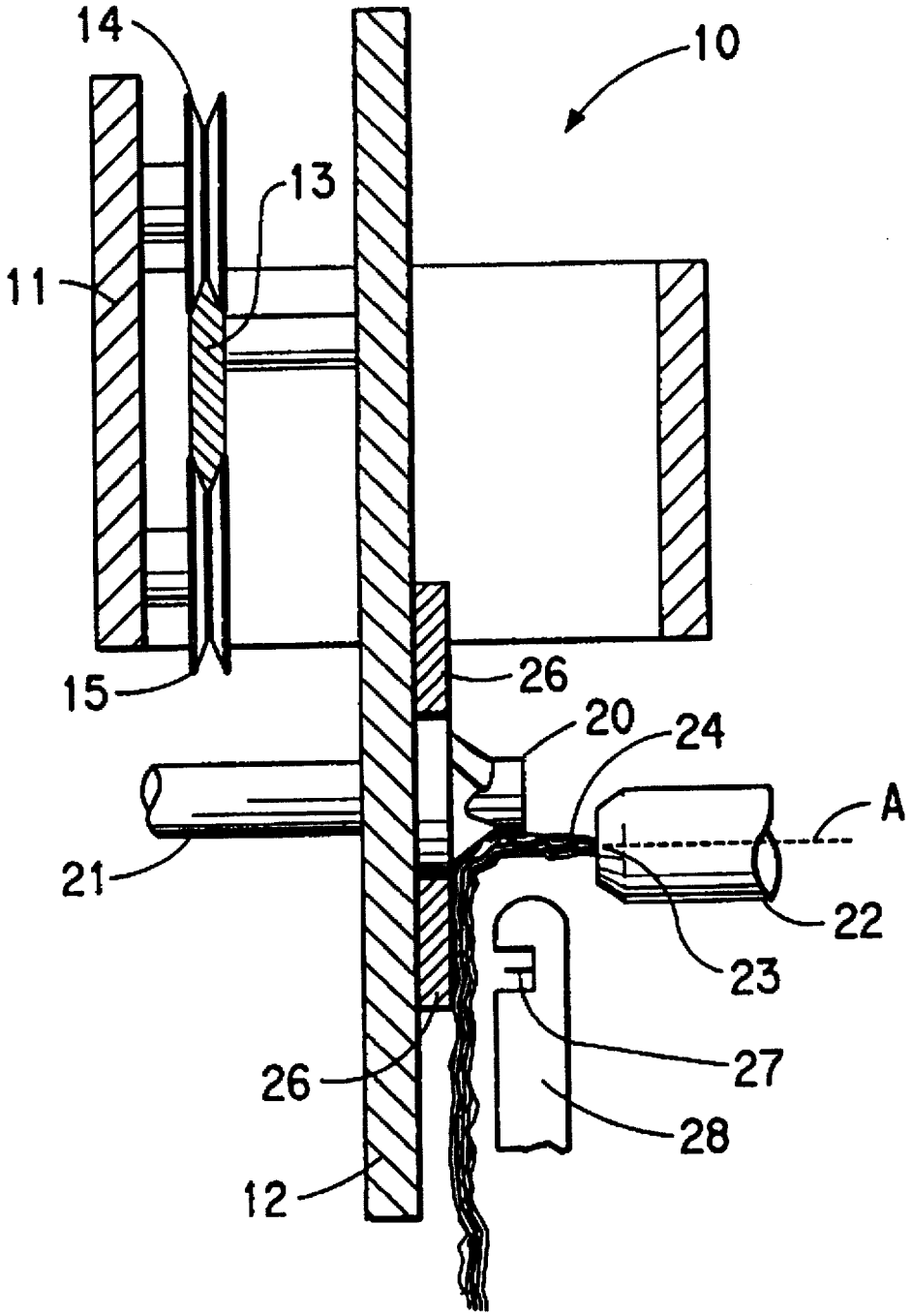
FIG. 3 is a cross-sectional view taken along line 3—3 of FIG. 2 showing the apparatus of the invention, including the means for flash spinning polymer solution.

FIGS. 1, 2 and 3 combine to show a preferred embodiment of the invention. The assembly 10 consists of a stationary frame 11, on which is mounted a pivot plate 12 on which is mounted a baffle 20 which may be rotated by drive motor 21 (shown only in FIG. 3). An annular target plate 26 is also mounted on pivot plate 12. Attached to the pivot plate is curved vee rail 13 resting on and engaging rollers 15 and 16 which are mounted on stationary frame 11 as is guide roller 14 resting on and engaging the top of the vee rail. The pivot plate pivots around point A as shown in FIGS. 2 and 3, and is positioned by rack 17 in conjunction with pinion 18 which is rotated by motor 19. (Alternatively, the pivot plate could be pivoted around the pivot point by attaching the pivot plate to the stationary frame through a pivot arm and a series of linkages.)

Referring primarily to FIG. 3, the spinning process is described as follows. Polymer solution from a supply source not shown is fed to spinneret pack 22 and through spinneret orifice 23. The extrudate from the spinneret orifice 23 is a plexifilamentary strand 24 entrained in a stream of high velocity gas. The plexifilamentary strand entrained in the gas strikes the contoured surface of rotating baffle 20 at point A. The strand along with the gas is deflected into a generally vertical plane and simultaneously spread laterally to form a web which is oscillated from side to side as the baffle 20 rotates. The web passes over a slowly rotating annular target plate 26 (drive not shown) mounted on the pivot plate 12 and the web is charged (given an electrostatic charge) by a multi-needled ion gun 27 which is set into an aerodynamic shield member 28 of which only the tip portion is shown. The web then passes between shield member 28 and a facing shield (not shown) which abuts the target plate, on its way to a collecting belt (not shown) to form a non-woven sheet.

For adjusting (tuning) the position of the web as it is laid on the collection belt between adjacent assemblies, the pivot plate is pivoted right or left from its center position to deflect the web to a new position for adjusting the local basis weight across the sheet being formed by multiple spinning assemblies. Adjustment is especially needed when one assembly is inoperative or removed for servicing.

What is claimed is:

1. An apparatus for forming a fibrous web which comprises:

(a) a stationary frame, (b) a pivot plate mounted on said stationary frame for movement about a pivot point axis, (c) means for flash spinning a polymer solution to form a plexifilamentary strand entrained in a gaseous stream located adjacent said pivot point and positioned so that the trajectory path of the stream and the pivot point axis are at least approximately coincident, (d) a baffle mounted for rotation on said pivot plate having its center of rotation adjacent the pivot point axis of the pivot plate, said baffle intersecting the coincident axis of the pivot point axis and the trajectory path of the gaseous stream, said baffle having a contoured surface facing the means for flash spinning, whereby plexifilamentary strand upon striking the contoured surface of the baffle will be spread to form a web, (e) means for moving said pivot plate about its pivot point axis whereby the angle at which plexifilamentary strand entrained in the gaseous stream leaves the baffle after striking the contours of the contoured surface of the baffle can be adjusted and thereby alter the direction web moves on leaving the surface of the baffle or the amplitude of oscillation of the web.

2. The apparatus of claim 1 in which the pivot plate is mounted to said stationary frame through a curved vee rail affixed to the pivot plate and rollers affixed to the stationary frame which engage the vee rail.

3. The apparatus of claim 1 which also includes a charging means located below the baffle for forming an electrostatic charge on web and thus further spreads web.

4. The apparatus of claim 3 in which an aerodynamic shield extends below the charging means, said shield helping to control the direction of movement of charged web.

5. The apparatus of claim 1 in which the means for moving the pivot plate on the pivot point is computer controlled motor acting through a rack and pinion.

6. The apparatus of claim 1 in which the contoured surface of the baffle has at least 3 lobes that are spaced equally around the axis of rotation of the baffle.

* * * * *